US006609908B2

(12) United States Patent
Guilmette et al.

(10) Patent No.: US 6,609,908 B2
(45) Date of Patent: Aug. 26, 2003

(54) REPLACEABLE HEATER COVER

(75) Inventors: Dennis L. Guilmette, Akron, OH (US); Joe R. McAfee, Pepper Pike, OH (US); William B. Bilyj, Brunswick, OH (US)

(73) Assignee: ETS Schaefer Corporation, Macedonia, OH (US)

( * ) Notice: Subject to any disclaimer, the term of this patent is extended or adjusted under 35 U.S.C. 154(b) by 0 days.

(21) Appl. No.: 10/010,364

(22) Filed: Nov. 13, 2001

(65) Prior Publication Data

US 2003/0091951 A1 May 15, 2003

(51) Int. Cl.[7] ..... F27D 1/18

(52) U.S. Cl. ..... 432/250; 126/190; 122/497; 110/182; 49/463

(58) Field of Search ..... 432/73, 224, 250; 110/173 C, 181, 182; 49/188, 389, 463; 122/497, 498; 266/280; 126/190

(56) References Cited

U.S. PATENT DOCUMENTS 1,126,674 A 1/1915 Johnson
3,224,420 A * 12/1965 Borman ..... 122/497
4,033,827 A * 7/1977 White, Jr. ..... 202/248
4,492,382 A 1/1985 Hounsel
4,605,206 A 8/1986 Hounsel
4,640,202 A 2/1987 Schraff et al.
4,718,643 A 1/1988 Gitman
4,852,858 A 8/1989 Weber
4,883,002 A * 11/1989 Schuster ..... 432/250
4,919,398 A 4/1990 Hounsel
5,118,085 A 6/1992 Forte et al.
5,193,998 A * 3/1993 Hack et al. ..... 432/250
5,217,369 A * 6/1993 Brown et al. ..... 432/250
5,645,791 A 7/1997 Fuchs et al.
6,017,215 A * 1/2000 Lillja et al. ..... 432/250
6,155,333 A 12/2000 Vallomy

* cited by examiner

*Primary Examiner*—Gregory Wilson
(74) *Attorney, Agent, or Firm*—Thompson Hine LLP

(57) ABSTRACT

A replaceable heater cover including a frame that is shaped to be removably coupled to an outer surface of a heater and an insulating material coupled to the frame. The insulating material is shaped to receive a vessel thereon during heating of the vessel, the insulating material including an opening for allowing hot gases to pass therethrough to heat a vessel that is located on the insulating material.

28 Claims, 7 Drawing Sheets

REPLACEABLE HEATER COVER

The present invention is directed to a cover for a heater, and more particularly, to a replaceable cover for a heater.

BACKGROUND OF THE INVENTION

In metals industry plants, such as steel mills, metal handling equipment, such as vessels, ladles and the like are used to transport molten metals between various on-site locations. In order to reduce the thermal stresses on the metal handling equipment, the metal handling equipment is typically heated or preheated by a vessel heating station (such as a ladle preheater) before the metal handling equipment receives molten metals. Most existing vessel heating stations include a heater with an outer protective wall or cover mounted on the heater. The vessel is pressed against the cover while the vessel is heated, for example, by a gas burner of the heater. The cover of the vessel heating station typically includes insulating or refractory materials to retain heat in the vessel, and to protect the outer vessel and heater from high temperatures.

Many existing heater covers include a layer of insulating or refractory material that is welded to the outer wall of the heater. However, when the cover must be replaced, for example due to damage or wear of the cover, the welds must be manually cut away, such as by a torch. The time and effort required to remove the cover or welded refractory or insulating material results in significant down-time for the vessel heating station.

Accordingly, there is a need for a cover for a vessel heater that can be easily replaced.

SUMMARY OF THE INVENTION

The present invention is a heater cover that can be quickly and easily mounted to, and de-mounted from, the outer wall of a heater. In one embodiment, the invention is a replaceable heater cover including a frame that is shaped to be removably coupled to an outer wall of a heater and an insulating material coupled to the frame. The insulating material is shaped to receive a vessel thereon during heating of the vessel. The insulating material may include an opening to allow hot gases to pass therethrough to heat a vessel that is located on the insulating material.

Other objects and advantages of the present invention will be apparent from the following description and the accompanying drawings.

DETAILED DESCRIPTION

Figure 1:
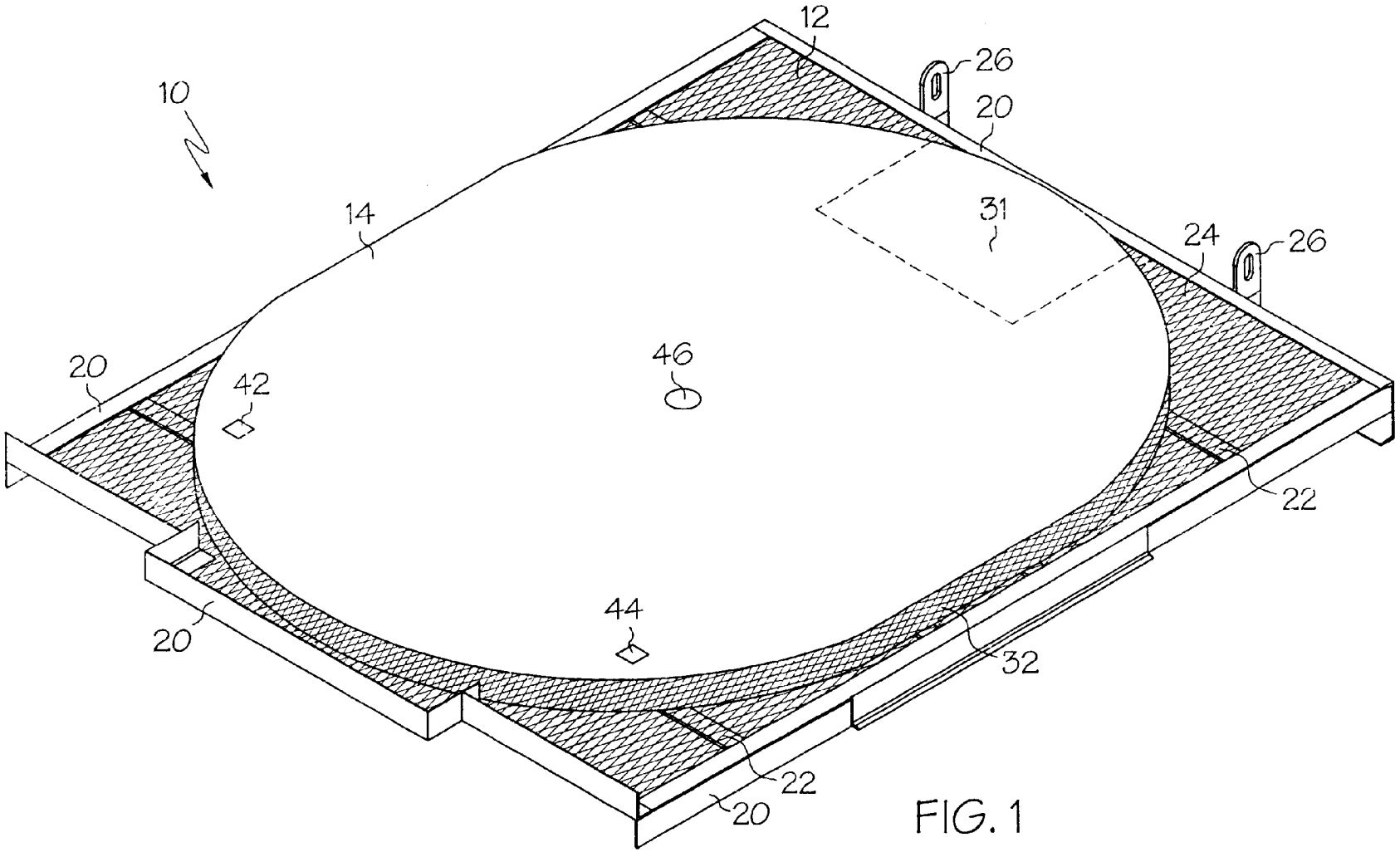
FIG. 1 is a perspective view of one embodiment of the heater cover of the present invention.

As shown in FIG. 1, the present invention is a replaceable heater cover 10 which includes a frame 12 and an insulating material 14 coupled to the frame 12. The frame 12 is shaped to be removably coupled to an outer wall 16 of a heater 18 of a heating station (see FIGS. 6–8) and can be made from a variety of materials. In the illustrated embodiment, the frame 12 includes an outer generally square support 20 extending about the perimeter of the frame 12, and a plurality of support ribs 22 extending between the lateral sides of the support 20. The frame 12 may also include a mounting face 24 located inside the perimeter of the support 20 and on top of the support ribs 22. In the illustrated embodiment, the mounting face 24 is a mesh material such as expanded metal, although nearly any heat resistant, preferably light-weight material may be used as the mounting face. The support 20 and support ribs 22 can be made from beams of carbon steel, but can also be made from a wide variety of other materials without departing from the scope of the invention.

The frame 12 may include a pair of spaced mounting lugs 26 located adjacent an upper edge of the frame 12. The mounting lugs 26 are preferably offset from the center of gravity of the frame with respect to the vertical axis of the frame 12, as will be discussed in greater detail below. The frame 12 also includes an upper lip 30, the upper lip 30 at least partially defining a channel 28 (see FIG. 7) located adjacent an upper edge of the frame 12. The upper lip 30 may have a set of threaded holes 33 that extend into the channel 28 to receive a pair of jack screws 34 therein (FIG. 8). The frame may also include a burner tube 36 that extends through the frame 12 and the insulating material 14.

As shown in FIG. 1, the insulating material 14 may be generally oval-shaped and located on the mounting face 24 of the frame 12. The outer shape of the insulating material 14 is preferably shaped to match the shape of the outer lip of the vessel (i.e., oval in the embodiment of FIG. 1), but the insulating material 14 can be nearly any desired shape or size. The insulating material 14 is preferably a refractory material such as ceramic fiber blanket, castable refractories or other refractory ceramic fiber ("RCF") materials. However, the insulating material 14 can be made from a wide variety of other materials, including but not limited to non-RCF insulating materials such as biosoluble fibers, or Minsil blanket manufactured by Minteq International, Inc. of Slippery Rock, Pa. However, the insulating material 14 can be made of nearly any material that is sufficiently heat resistant.

The insulating material 14 may be generally planar and include a recessed area 31 located adjacent a top edge of the insulating material 14. The insulating material 14 may be coupled to the frame 12 in a variety of attachment manners. In one case, as shown in FIG. 1, the frame 12 may include a mounting flange 32 of expanded metal extending around the perimeter of the insulating material 14 and coupled to the frame. The mounting flange 32 retains the insulating material 14 inside the mounting flange 32 to define an outer edge of the insulating material 14 and, if necessary, retain the insulating material 14 in compression (i.e. when the insulating material is in blanket form). However, the frame 12 need not include the mounting flange 32, particularly when the insulating material 14 is not in blanket form.

Figure 2:
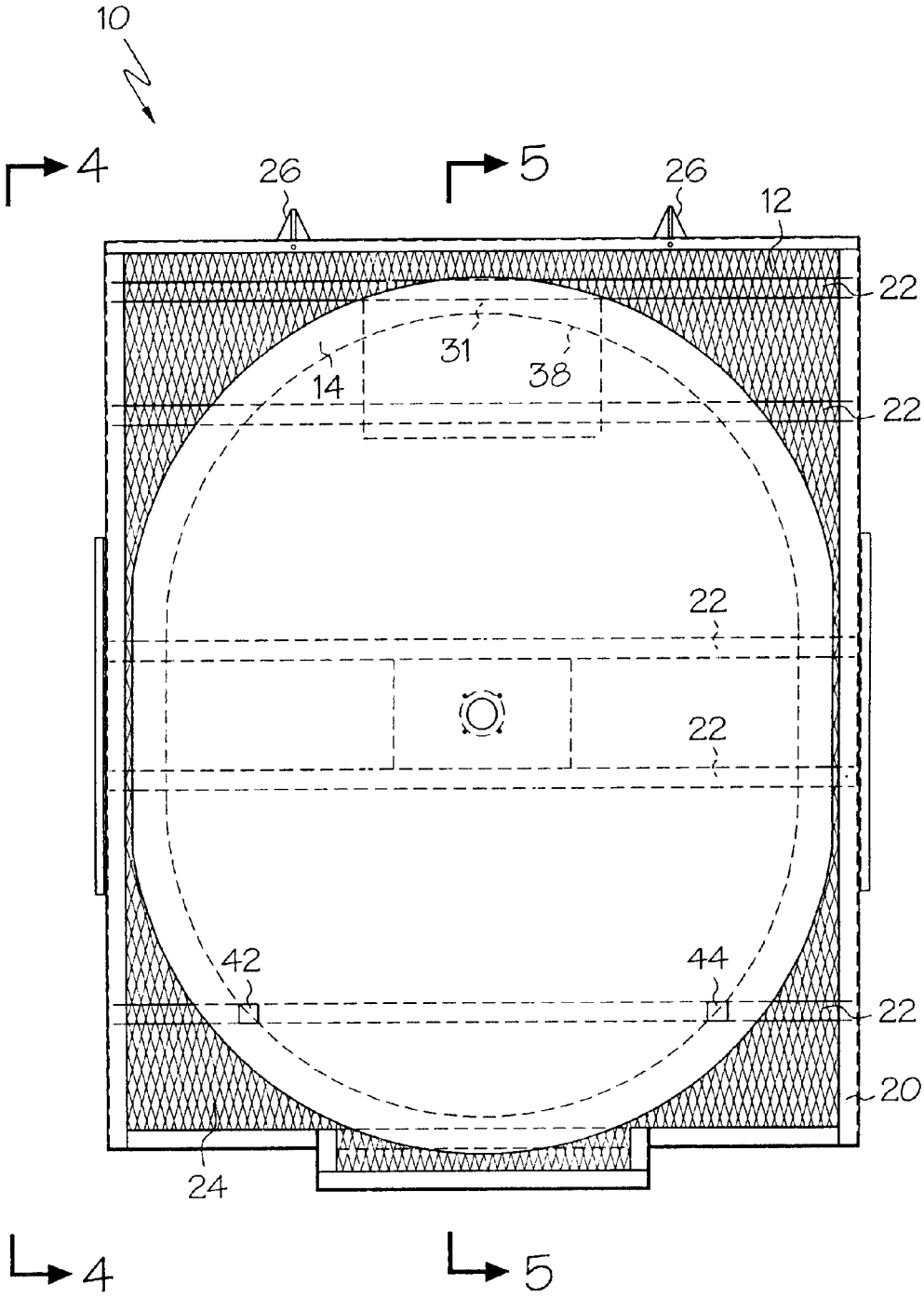
FIG. 2 is a front view of the heater cover of FIG. 1.
Figure 3:
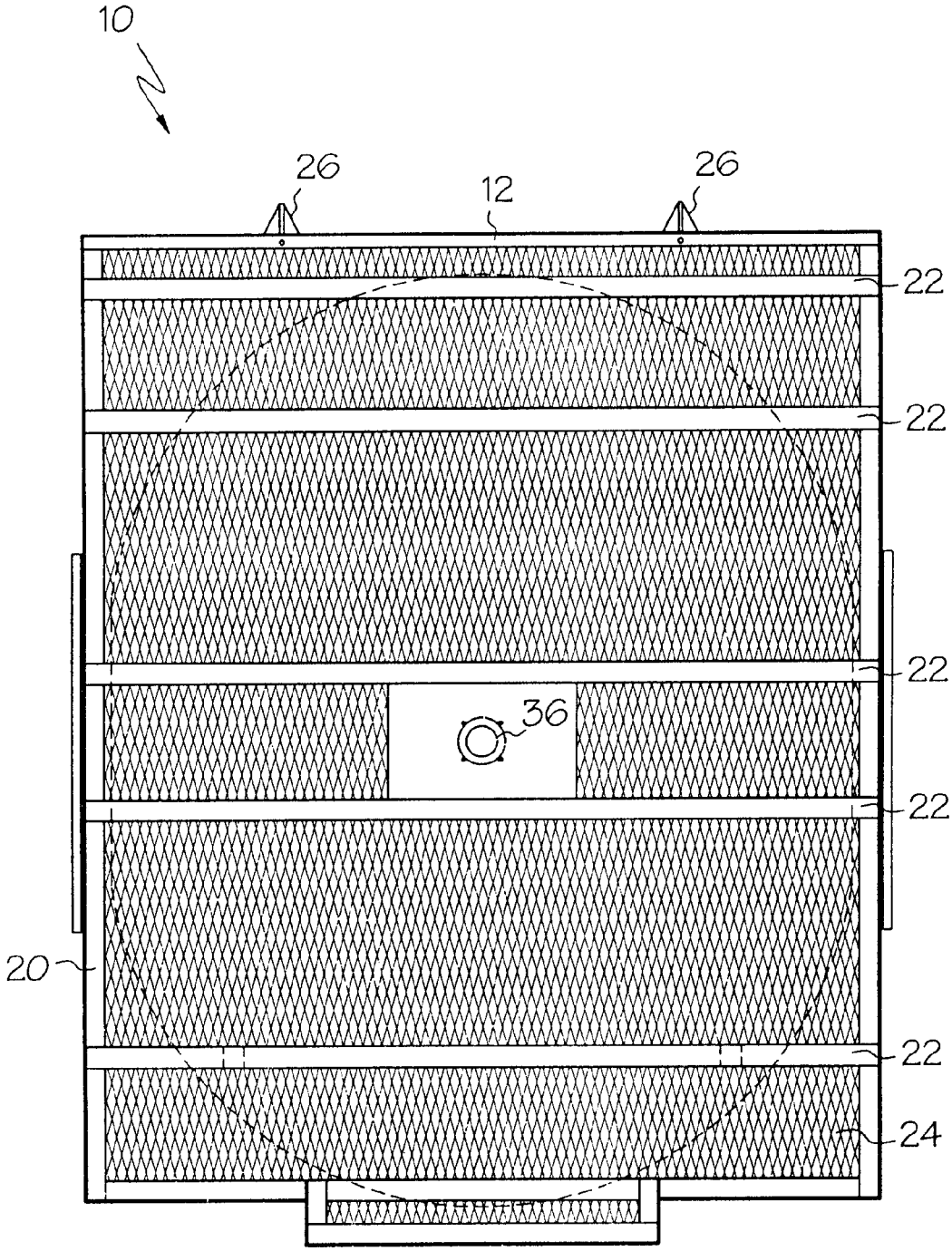
FIG. 3 is a back view of the heater cover of FIG. 1.
Figure 4:
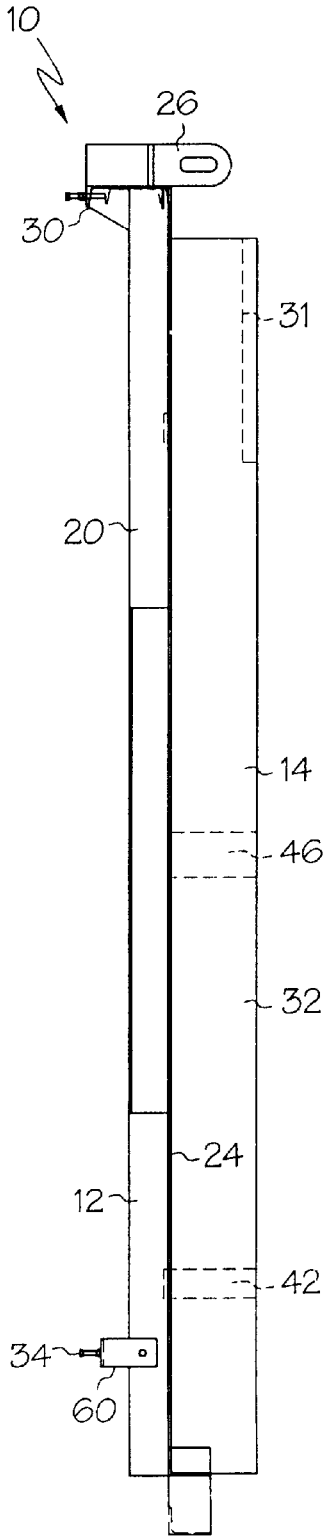
FIG. 4 is a side view of the heater cover of FIG. 1.
Figure 5:
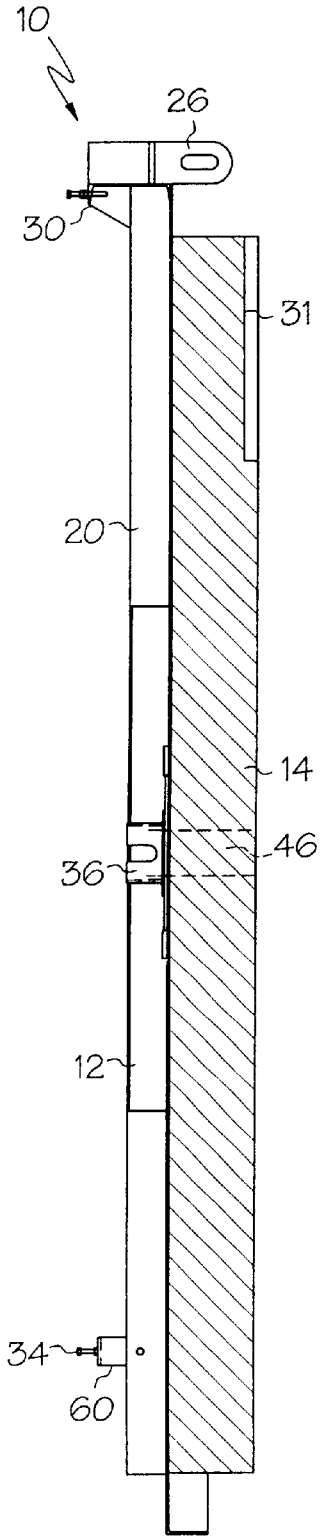
FIG. 5 is a side cross-section of the heater cover taken along line 5—5 of FIG. 2.

The insulating material 14 is shaped to receive a vessel 35 (FIG. 6) thereon during heating of the vessel 35, and the insulating material may be sized to be slightly larger than the outer profile of the vessel 35. For example, FIG. 2 illustrates, in phantom line 38, the outer perimeter of a vessel 35 that can be located against the insulating material 14. The insulating material 14 may be shaped to be slightly larger than the vessel 35 to ensure that the vessel 35 contacts the insulating material 14 at all times during heating of the vessel. The heater cover 10 may also include a pair of spaced relatively rigid impact bars or pads 42, 44 embedded in the insulating material 14. The impact bars 42, 44 are located to engage an outer lip of the vessel 35 to prevent the vessel 36 from crushing the insulating material 14.

The insulating material 14 may also include an opening 46 that is aligned with the burner tube 36 or tile of the frame 12. The burner tube 36 of the frame 12 may communicate with the opening 46, or the burner tube 36 may extend through the opening 46. Although the insulating material 14 preferably includes the opening 46 when the insulating material 14 is located on the heater and the heater is operated, the opening 46 may not necessarily be formed during manufacture of the heater cover 10. In this case the heater cover 10 can be shipped to a customer without the opening 46, and the customer can form the opening 46 in the insulating material 14 to ensure that the opening is precisely located in the desired position for the associated heater.

Figure 6:
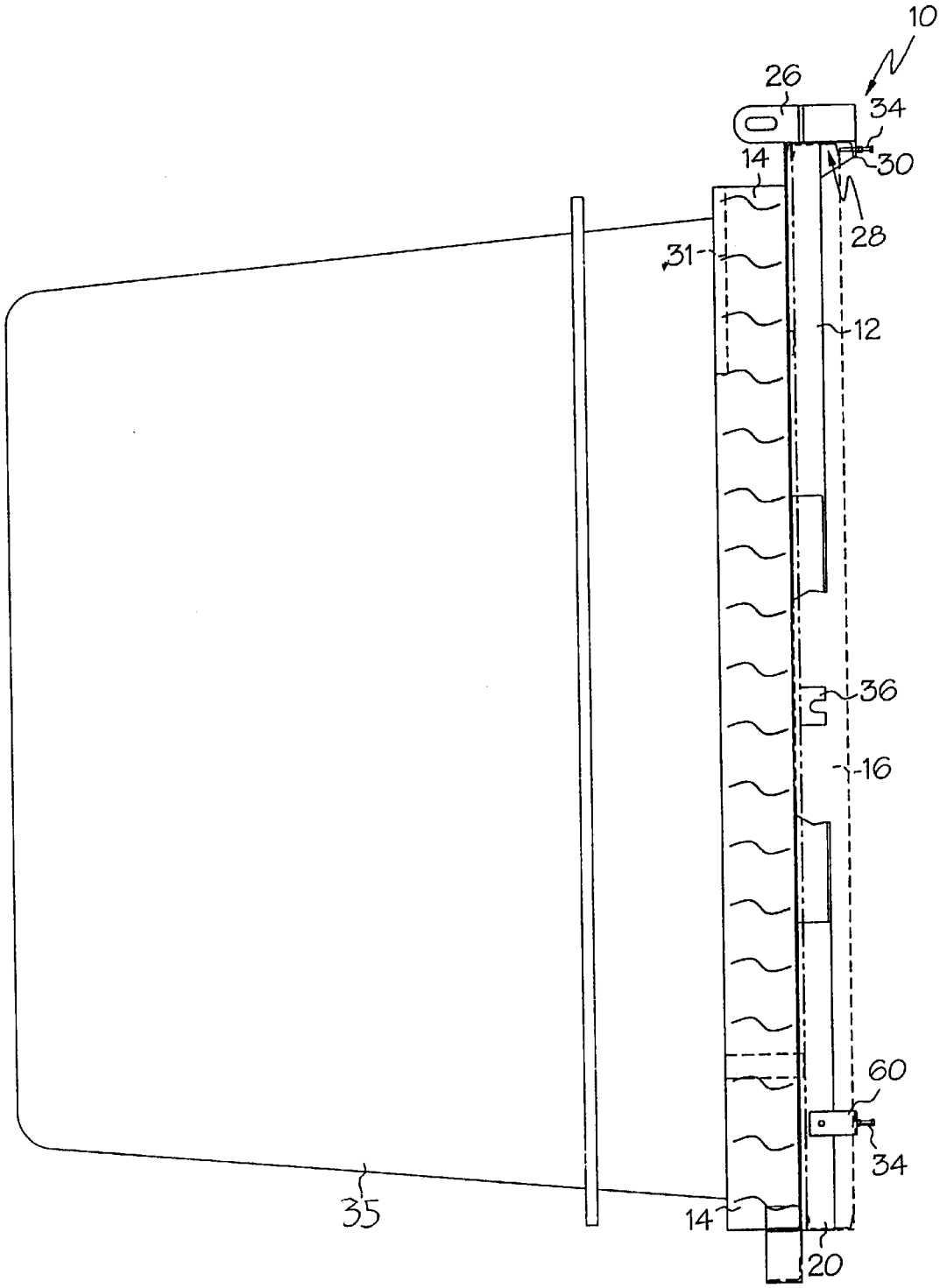
FIG. 6 is a side view of the heater cover of FIG. 1, with a vessel located against the heater cover.
Figure 7:
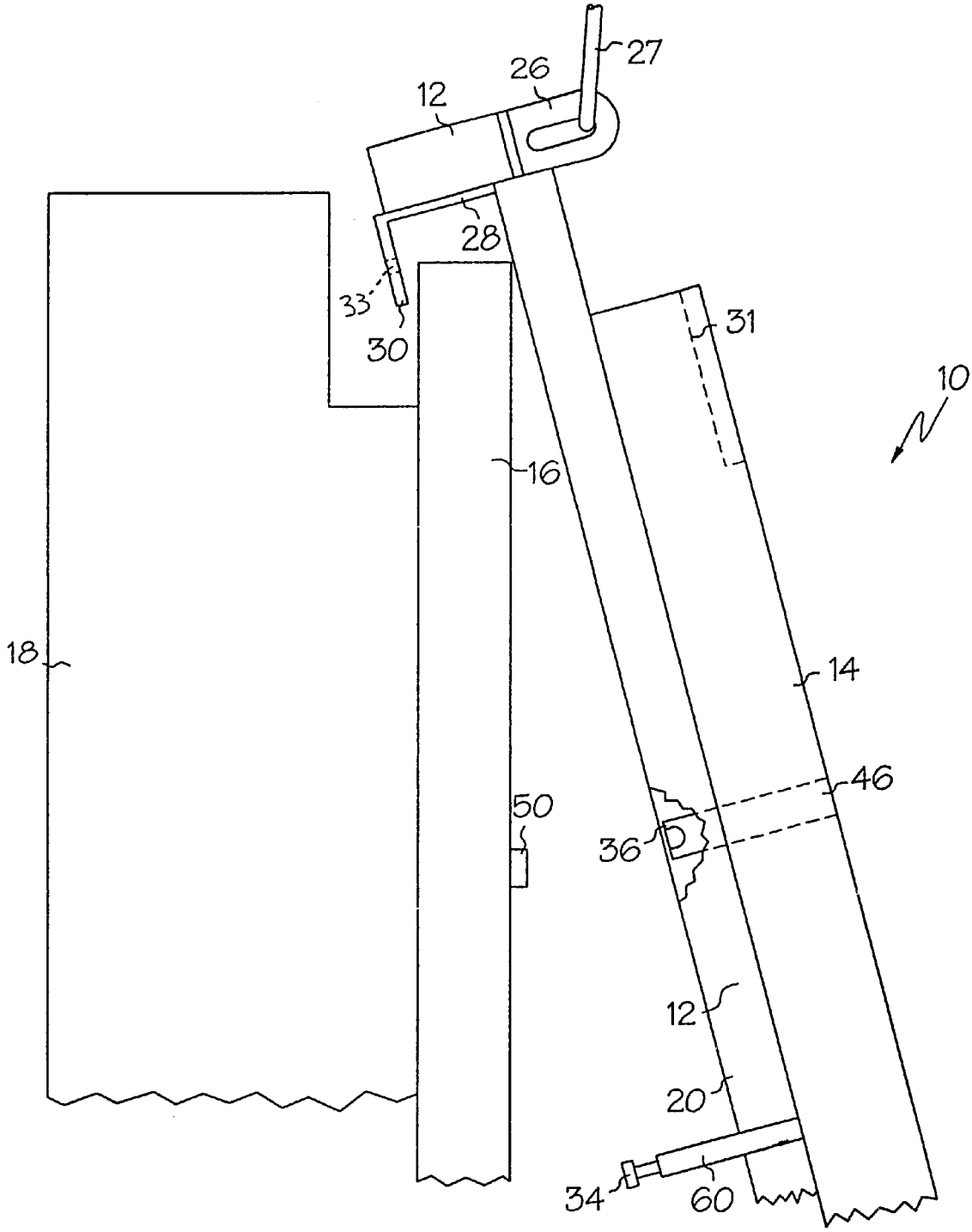
FIGS. 7 and 8 are schematic side views illustrating the mounting and demounting of the heater cover on a heater.
Figure 8:
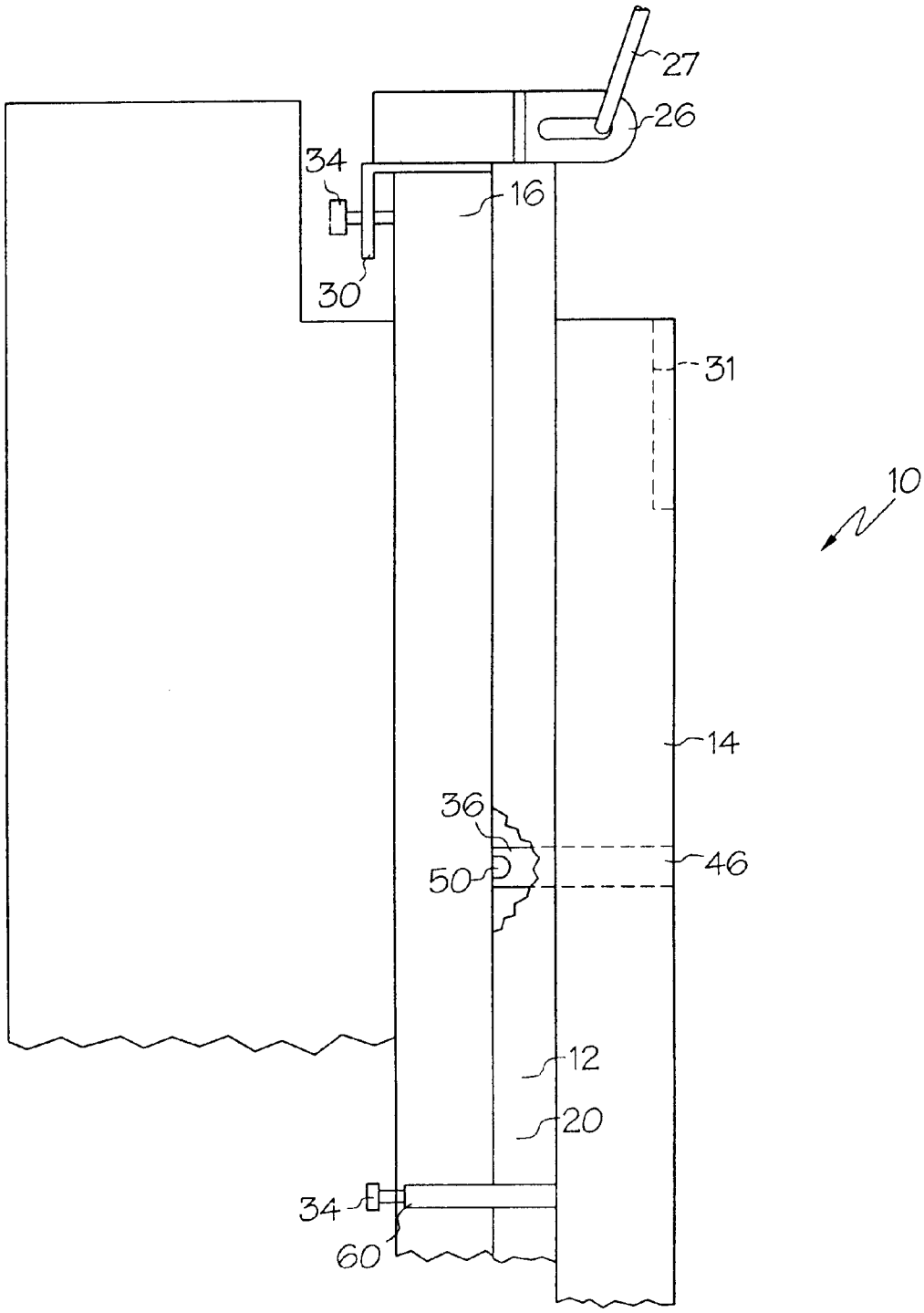

As shown in FIG. 7 and 8, the heater cover 10 is shaped to be mounted to a heater 18 having an outer wall 16, and the heater 18 may have a burner 50 which expels hot gasses to heat a vessel 35 located on the heater cover 10 (FIG. 6). When the heater cover 10 is mounted to the outer wall 16 of the heater 18 (FIG. 8), the burner tube 36 is aligned with the burner 50 (in the illustrated embodiment, the burner tube 36 receives the burner 50 therein) such that the hot gases created by the burner 50 can pass through the burner tube 36 and the opening 46 of the insulating materials and impinge upon the inner surface of the vessel 35, thereby heating the vessel 35. The recessed area 31 of the insulating material 14 provides a flue which enables gases to escape from the closed volume created by the vessel 35 and the heater cover 10 (known as "directional fluing") (see FIG. 6). Alternately, the flue may be a recess formed in the heater wall with an opening extending directly through the insulating material.

Furthermore, the insulating material 14 need not include the recessed area 31 and the heater wall may not include the recess. In this case, the heater cover 10 is preferably slightly spaced away from the heater 18 to enable hot gasses to escape through the gap formed between the heater cover 10 and heater 18 (known as "perimeter fluing"). If desired the impact bars 42, 44 may be shaped to extend beyond the front surface of the heater 18 to provide a stop which the vessel 35 can engage during perimeter fluing.

In order to mount the heater cover 10 to the outer wall 16 of the heater 18, the heater cover 10 may be lifted by its mounting lugs 26, such as by passing a chain or cable 27 through the lifting lugs 26 and connecting the chain to movable machinery (not shown), such as a forklift or the like. Because the mounting lugs 26 are offset from the center of gravity of the heater cover 10 with respect to a vertical axis of the heater cover 10, when the heater cover 10 is lifted by its mounting lugs 26, the heater cover tilts to an angled position, such as the position shown in FIG. 7. The heater cover can then be moved such that it is located adjacent to the outer wall 16 of the heater 18, as shown in FIG. 7. The heater cover is then slowly lowered until the lip 30 of the frame 12 fits over the outer wall 16 and the outer wall 16 is received in the channel 28, as shown in FIG. 8. The angle formed by the heater cover 10 while it is lifted by its lugs 26 ensures that the lower portions of the heater cover 10 are spaced away from the wall 16 of the heater 18, thereby reducing the chance of damaging the heater cover 10 and increasing the ease of locating the wall 16 in the channel 28 (FIG. 7).

Once the wall 16 is received in the channel 28, the cover 10 is then lowered until the entire weight of the heater cover 10 is supported by the wall 16 (FIG. 8). In this manner, the channel 28 and lip 30 of the frame 12 enable quick loading of the heater cover 10 on the heater 18, and maintains the heater cover 10 in place while it is more securely fastened to the wall 16. As shown in FIG. 8, a set of jack screws 34 may be passed through the threaded holes 33 in the lip 30 to pull the wall 16 and cover 10 into close engagement. The heater cover 10 should be located on the heater 18 such that the hole 46 in the insulating material 14 and the burner tube 36 are aligned with the burner 50 of the heater 18. However, it should be understood that the heater cover 10 of the present invention may be used with other types of heaters and preheaters, and in such cases the cover 10 may or may not include the hole 46, burner tube 36, recess 31 or impact bars 42, 44.

The heater cover 10 may also include a set of brackets 60 coupled to the frame 12 shaped to fit around the wall 16 to couple the cover 10 to the wall 16. In this manner, once the heater cover 10 is located in its desired position, a set of jack screws 34 (FIG. 8) can be threaded through each bracket 60 to pull the wall 16 and cover 10 into engagement.

In order to uncouple the heater cover 10 from the wall 16 of the heater 18, for example for repair or replacement, the jack screws 34 in the brackets 60 and lip 30 are loosened, and the heater cover 10 is lifted away from the outer wall 16 of the heater 18. The heater cover 10 is preferably lifted by its mounting lugs 26 so that the heater cover then tilts to its position as shown in FIG. 7 and the lower surface of the heater cover 10 is spaced away from the lower edge of the wall 16. The heater cover 10 can then be moved to another location for repair or further processing. If necessary, a replacement heater cover 10 can then be lifted into place in the same manner as described above.

The heater cover 10 may include various other structures, such as brackets, flanges, and the like which can fit over various protrusions, such as bolts, studs, flanges, brackets, etc. of the heater 18 without departing from the scope of the invention. In this manner, the weight of the heater cover 10 may be supported by the heater 18 while the heater cover 10 is more securely coupled to the heater 18.

Having described the invention in detail and by reference to the preferred embodiments, it will be apparent that modifications and variations thereof are possible without departing from the scope of the invention.

What is claimed is:

1. A replaceable heater cover for use with a heater for heating metal handling equipment comprising:

a frame that is shaped to be removably coupled to an outer wall of a heater for heating metal handling equipment wherein said frame includes a connecting portion that is shaped to fit over a portion of said heater such that said heater cover can be suspended from said heater to removably couple said heater cover to said heater; and an insulating material coupled to said frame for receiving a vessel thereon during heating of said vessel, said insulating material including an opening for allowing hot gases to pass therethrough to heat a vessel that is located on said insulating material.

2. The heater cover of claim 1 further wherein said insulating material is sized to be slightly larger than the outer profile of a vessel located on said insulating material.

3. The heater cover of claim 1 wherein said frame includes a mounting face, said insulating material being coupled to said mounting face.

4. The heater of claim 3 wherein said mounting face is expanded metal.

5. The heater cover of claim 1 wherein said insulating material is generally oval in front view.

6. The heater cover of claim 1 further comprising a mounting flange coupled to said frame, said mounting flange being sized to closely receive said insulating material therein to couple said insulating material to said frame.

7. The heater cover of claim 1 wherein said insulating material is a ceramic fiber blanket.

8. The heater cover of claim 1 wherein said frame includes at least one mounting lug adjacent an upper edge of said frame, said mounting lug being offset from a center of gravity of said heater cover with respect to a vertical axis of said heater cover.

9. The heater cover of claim 1 wherein said connecting portion includes channel adjacent an upper edge of said frame, said channel being shaped to receive the outer wall of a heater therein.

10. The heater cover of claim 9 wherein said connecting portion includes a set of threaded holes shaped to receive a screw therethrough such that said screws can be threaded through said holes and into said channel to engage an outer wall of a heater when said outer wall is received in said channel.

11. The heater cover of claim 1 further comprising a mounting bracket coupled to said frame, said bracket being shaped fit about an outer wall of a heater when said frame is mounted to said heater, said bracket including a threaded hole shaped to receive a screw therethrough such that said screw can urge said frame against said outer wall.

12. The heater cover of claim 1 wherein said connecting portion is a lip located at an upper edge of said frame.

13. The heater of claim 1 wherein said insulating material includes a generally planar outer surface and said insulating material includes a recessed area located adjacent to an upper outer edge of said insulating material to enable gases to escape when a vessel is located on said heater.

14. The heater of claim 1 further comprising a pair of relatively rigid impact bars embedded in said insulating material, said impact bars being located to protect said insulating material from said vessel.

15. The heater cover of claim 1 wherein said connecting portion includes a portion of said heater cover located above a portion of said heater.

16. A replaceable heater cover for use with a heater comprising:

a frame that is shaped to be removably coupled to an outer wall of a heater;

an insulating material coupled to said frame, said insulating material including an opening for allowing hot gases to pass therethrough to heat a vessel that is located on said insulating material; and a burner receiving component coupled to said frame, said burner receiving component being shaped and located to closely receive a burner of said heater therein or thereon to guide gases from said burner through said opening.

17. A replaceable heater cover for use with a heater for heating metal handling equipment comprising:

a frame including a support structure that is shaped to cooperate with said heater to removably couple said frame to an outer wall of a heater wherein said frame includes a connecting portion that is shaped to fit over a portion of said heater such that said heater cover can be suspended from said heater to removably couple said heater cover to said heater; and an insulating material coupled to said frame for receiving a vessel thereon during heating of said vessel.

18. The heater cover of claim 17 wherein said support structure is a lip located at an upper edge of said frame, said lip being shaped to fit over an outer wall of said heater.

19. A heater comprising:

a heater component for heating metal handling equipment having an outer generally non-thermally insulating outer wall and a burner; and a replaceable heater cover coupled to said heater, said replaceable heater cover including a frame that is shaped to be removably coupled to said outer wall and an insulating material coupled to said frame for receiving a vessel thereon during heating of said vessel, said insulating material including an opening in communication with said burner to allow hot gases to pass therethrough to heat a vessel that is located on said insulating material.

20. The heater of claim 19 wherein said frame includes an upper lip that fits over said outer wall.

21. The heater of claim 19 wherein said frame includes a connecting portion that is shaped to fit over a portion of said heater such that said heater cover can be suspended from said heater to removably couple said heater cover to said heater.

22. A method for mounting an insulating material to the outer wall of a heater for heating metal handling equipment comprising the steps of:

providing a replaceable heater cover including a frame and an insulating material coupled to said frame for receiving a vessel thereon during heating of said vessel wherein said frame includes a connecting portion that is shaped to fit over a portion of said heater;

mounting said frame to said outer wall such that said frame and said outer wall cooperate such that said outer wall supports the weight of said frame and said heater cover is suspended from said outer wall; and securing said heater cover to said outer wall.

23. The method of claim 22 wherein said frame includes an upper lip, and wherein said mounting step includes locating said upper lip over said outer wall such that said outer wall supports the weight of said heater cover.

24. The method of claim 22 wherein said securing step includes mounting brackets to secure said heater cover to said outer wall.

25. The method of claim 22 wherein said heater includes a burner and said insulating material includes an opening, and wherein said mounting step includes aligning said frame such that said opening is in communication with said burner.

26. A replaceable heater cover comprising:

a frame that is shaped to be removably coupled to an outer wall of a heater;

a generally rigid connecting portion shaped to extend between said frame and said heater to removably couple said heater cover to said heater; and an insulating material coupled to said frame for receiving a vessel thereon during heating of said vessel, said insulating material including an opening for allowing hot gases to pass therethrough to heat a vessel that is located on said insulating material.

27. A heater comprising:

a heater component having an outer wall and a burner;

a replaceable heater cover coupled to said heater, said replaceable heater cover including a frame and an insulating material coupled to said frame, said insulating material including an opening in communication with said burner to allow hot gases to pass therethrough; and a generally rigid connecting portion extending between said heater component and said heater cover to removably couple said heater cover and said heater component.

28. The heater of claim 27 wherein said connecting portion is fixedly coupled to said heater cover and is not fixedly coupled to said heater.

* * * * *